United States Patent [19]

Hope

[11] 4,403,492

[45] Sep. 13, 1983

[54] STRIP COOLING

[75] Inventor: Thomas Hope, Doncaster, England

[73] Assignee: Davy-Loewy, Limited, Sheffield, England

[21] Appl. No.: 330,937

[22] Filed: Dec. 15, 1981

Related U.S. Application Data

[63] Continuation of Ser. No. 89,499, Oct. 30, 1979, abandoned.

[30] Foreign Application Priority Data

Nov. 3, 1978 [GB] United Kingdom ..... 7843137

[51] Int. Cl.[3] ..... B21B 27/06

[52] U.S. Cl. ..... 72/201; 72/227; 72/250

[58] Field of Search ..... 72/201, 227, 250, 236, 72/200, 202

[56] References Cited

U.S. PATENT DOCUMENTS

| | | | |
|---|---|---|---|
| 2,067,514 | 1/1937 | Trinks | 72/202 |
| 2,230,897 | 2/1941 | McBain et al. | 72/201 |
| 2,811,059 | 10/1957 | Appleby | 72/201 X |
| 3,151,197 | 9/1964 | Schultz | 72/201 X |
| 3,613,421 | 10/1971 | Repper | 72/235 |
| 3,805,568 | 4/1974 | Properzi | 72/201 X |
| 3,998,084 | 12/1976 | Rerecich | 72/201 |
| 4,272,976 | 6/1981 | Pizzedaz | 72/201 X |

*Primary Examiner*—Frank T. Yost

*Attorney, Agent, or Firm*—Daniel Patch; Suzanne Kikel

[57] ABSTRACT

For performing interstand cooling in a tandem rolling mill, at least one of the stands (12, 13) has delivery guides (17, 18) which incorporate equipment for delivering coherent, non-turbulent, curtains of coolant on to the faces of the strip rolled by that stand. The equipment for each guide (17, 18) consists of a coolant manifold (25, 32) formed within the guide structure and a communicating curtain-discharging nozzle (30, 36) which is recessed in the guide plate (21, 22) and which extends over almost the entire length of the guide. The manifold (25, 32) is supplied with coolant through pipes (26).

9 Claims, 2 Drawing Figures

STRIP COOLING

Figure 1:
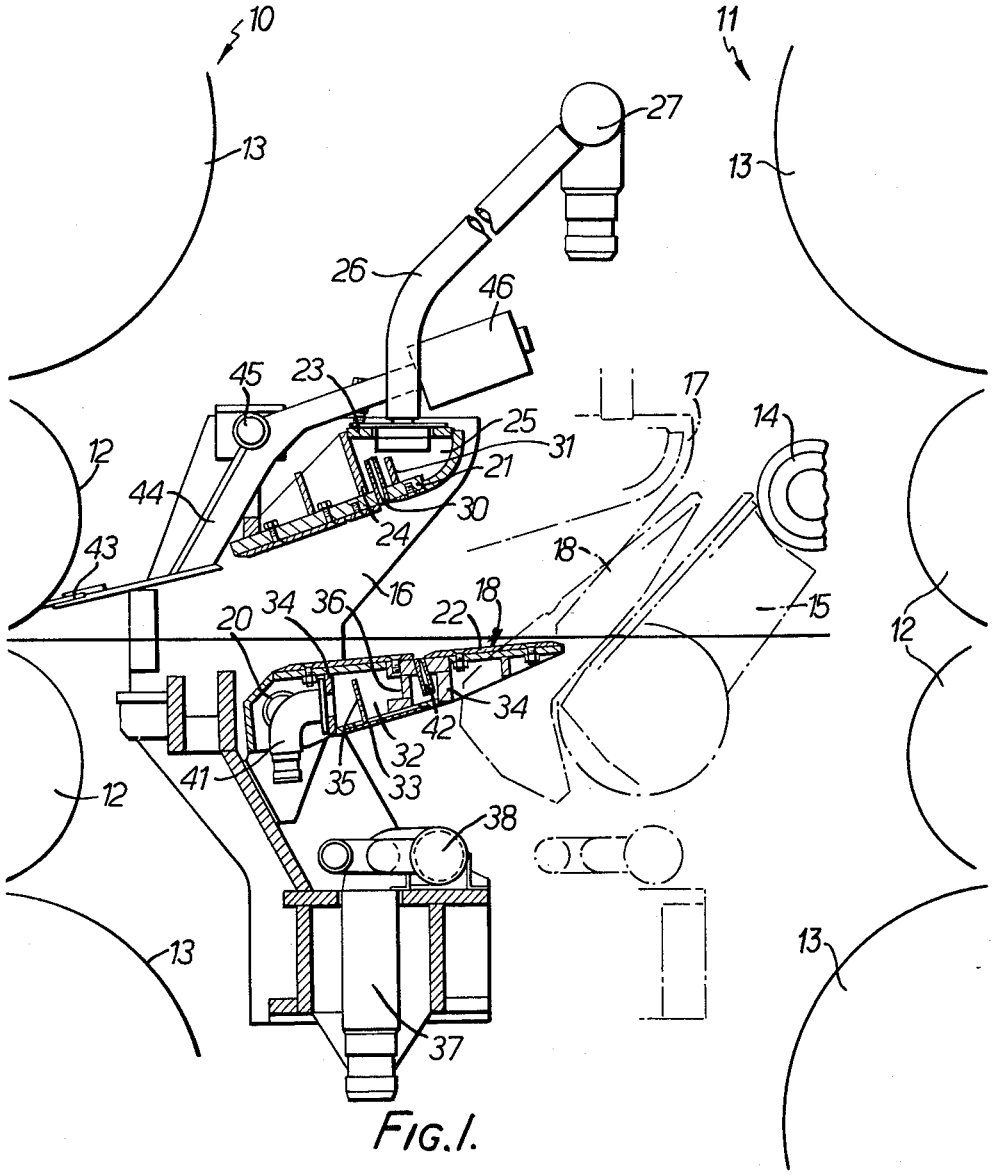

This a continuation of application Ser. No. 089,499, filed Oct. 30, 1979, now abandoned.

This invention relates to rolling mill equipment, and particularly to cooling equipment for a rolling mill in which elongate metal, such as strip, is rolled. The mill may be reversing, but is usually a continuous mill with a number of stands in tandem, e.g. a continuous strip finishing line.

The mill drives of a tandem mill are sufficiently powerful to enable strip having the maximum width that can be accommodated on the mill to be rolled at a given speed. Theoretically, strip which is narrower than the maximum width could be rolled at a higher speed without overloading the drives: but such higher speeds cannot normally be utilized, because the increase in rolling speed results in the strip leaving the mill at excessively high temperatures.

The strip temperature is capable of being controlled by interstand cooling of the strip. Interstand cooling by using sprays of coolant (usually water) applied to the upper face of the strip between successive stands is not satisfactory, because, as is well known, the cooling effect of high pressure sprays is insubstantial. The use of laminar jets of coolant as described in U.K. Patent Specifications Nos. 1148171 and 1290108 is more effective but the cooling effect of the jets is measurably affected by variation in the inclination of the strip caused by the action of the interstand looper. Due to the effect of gravity the cross section of the jet diminishes with distance of fall. Hence variations in the inclination of the strip may cause the jets to overlap or to underlap (i.e. to fail to meet), as they impinge on the strip face and may lead to a corresponding "striping" effect on the heat pattern of the strip.

It has recently been proposed to use a continuous non-turbulent curtain of coolant extending over the entire width of the strip for cooling strip on the run out table after it emerges from the tandem mill. Whereas the water curtain equipment can be easily accomodated downstream of the mill, it cannot easily be located in the limited space available between adjacent stands of a tandem mill, already occupied by loopers and other equipment. The presence of water curtain equipment in that space would restrict access to the pass-line and would itself be endangered by the occurrence of cobbles.

In the present invention, water curtain equipment is incorporated in a guide of a rolling mill stand, with the consequences that it does not occupy otherwise available interstand space and that its operation is little affected by the operation of an interstand looper. Thus, the present invention resides in the guide for a rolling mill stand having a guide plate which, when the guide is fitted adjacent the mill stand, acts to guide work relative to the stand, the guide having incorporated with it an elongate narrow discharge nozzle designed to deliver a coherent and non-turbulent curtain of coolant in a direction away from the guide plate for impingement of the work.

Preferably each of a pair of cooperating guides is provided with a curtain-nozzle so that both sides of the work receive impinging coolant curtains.

The nozzle is advantageously set in the guide plate, to avoid damage in the event of a cobbled strip.

The invention may further provide a tandem mill having a plurality of stands, at least one of which has a pair of guides provided with curtain nozzles as above described.

Figure 2:
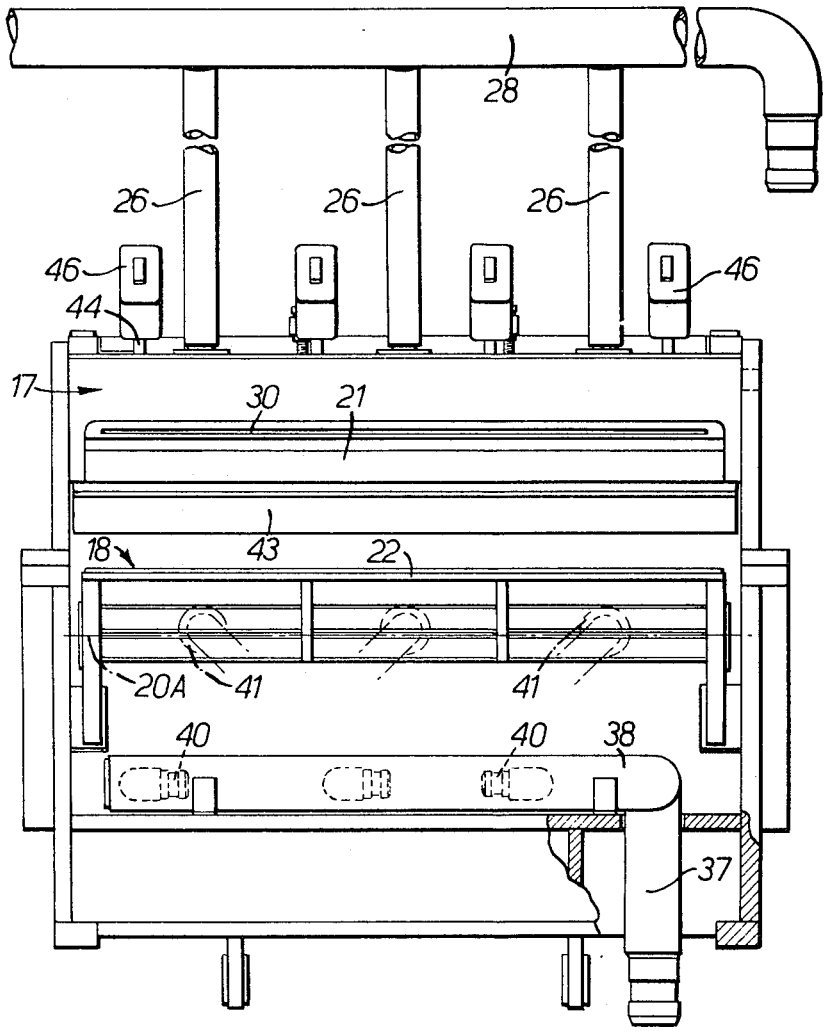

The invention will be more readily understood by way of example from the following description of a guide assembly for a stand of a tandem mill, incorporating equipment for delivering water curtains. Reference is made to the accompanying drawings, in which:

FIG. 1 is a vertical section through the delivery guide assembly of the stand, and FIG. 2 is an view of the delivery guide assembly in the direction of the mill stand.

In FIG. 1, stands 10 and 11 are represented schematically by work rolls 12 and back-up rolls 13. The strip leaving the work rolls 12 of stand 10 passes from left to right in FIG. 1, before entering the next stand 11 downstream. Between the stands there is a conventional looper comprising a looper roll 14 carried by a looper arm 15, the inclination of which can be varied in order to adjust the inter-stand tension.

The stand has a delivery guide assembly straddling the pass-line and consisting of end plates 16 located on opposite sides of the strip path and carrying between them a fixed upper guide 17 and a pivotable lower guide 18; the lower guide can pivot on a cross-shaft 20 about axis 20A (FIG. 2). In order to provide access to the stand 12, 13, the guide assembly can be moved away from that stand to the position in chain line in FIG. 1. When so moved, the lower guide 18 is pivoted so as to take up the position shown and thereby to avoid the looper arm 15. Each of the guides 17 and 18 is a fabrication which supports a guide plate facing the pass-line. The guide plate of guide 17 is indicated at 21, and that of guide 18 at 22.

Each of the delivery guides 17 and 18 contains means for deliverying a water curtain onto the adjacent face of the strip leaving the stand 12, 13. Thus, the upper guide 17 is closed at the top by a cross plate 23, which with side plates 24 and a part of the guide plate 21 itself forms a manifold 25 which extends the full width of the guide and hence extends over the maximum width of strip to be rolled by the mill. The manifold 25 is supplied with coolant by three flexible pipes 26 which are secured in plate 23 at intervals along its length as shown in FIG. 2 and which are also connected through rotary joints 27 to a water header 28. Set in the face of the guide plate 21 there is secured a thin long nozzle 30 extending over the full width of the guide 17 and recessed in ambush form to avoid it being endangered by cobbles. Within the manifold 25 is a baffle plate 31 designed to ensure constant flow of liquid to the nozzle along its length.

Similarly, the lower guide 18 is formed with a manifold 32 formed by a bottom plate 33, side plates 34 and part of guide plate 22, and containing baffle plates 35 and 36 which correspond in function to the baffle plate 31. The supply of liquid to manifold 32 is from a supply pipe 37 and through a header 38 and flexible pipes (not shown) connecting nipples 40 on the header 38 to elbow joints 41 secured in plate 34. The guide plate 22 carries an ambushed, narrow nozzle 42, which is similar to the nozzle 30 and is similarly mounted. When the guide assembly is moved to the inoperative position as shown in chain line in FIG. 1, the headers 28 and 38 move with it.

Each of the nozzles 30 and 42 deliver onto the adjacent face of the strip from the stand 12, 13 a coherent, non-turbulent, curtain of water which has the effects of causing substantial cooling of the strip as it passes from the illustrated stand to the next stand down-stream and of suppressing scale formation. By means of the water curtains produced by those nozzles, the rate of delivery of water from which is controlled by the supplies, it is possible to control the temperature of the strip passing to the next stand and thereby to hold the strip temperature at a desired level, regardless of the strip heating caused by rolling. It is advantageous if, as shown, the nozzles 30 and 42 are so arranged that the upward curtain from nozzle 42 impinges on the underside of the strip upstream of the impingement of the curtain from nozzle 30 on the upper strip side, nozzle 42 being inclined to the plane of guide plate 22 for that purpose. It has been found that that arrangement improves the operator's view of the roll gap.

In order to obtain a more precise control over the cooling effect of the water curtains, the effective width of each nozzle 30, 42 may be adjustable so that the rate at which the coolant is delivered to the rolled strip can be varied.

As the water curtain equipment is incorporated within the guides, it does not encumber the limited space available between the stands of the mill. In addition, the water curtains impinge on the strip so close to the mill stand that the cooling effect is little affected by the variation in the angle of the looper arm 15.

In a continuous strip mill, the delivery guides of each of the stands can be supplied with water curtain means as illustrated in the drawings, or alternatively only some of those stands may be so supplied.

FIGS. 1 and 2 further show a stripper plate 43 carried by arms 44 which are rotatably mounted on a shaft 45 and counter weighted by counter weights 46.

In accordance with the provisions of the Patent Statutes I have explained the principle and operation of my invention and have illustrated and described what I consider to represent the best embodiment thereof.

I claim:

1. In combination with a hot metal strip rolling mill stand for rolling a hot strip along a horizontal given path of travel, including means for deflecting said strip after leaving said stand away from said given path of travel, and wherein in its maximum deflected position said deflected strip is a substantial distance away from said given path of travel, a guide means for receiving said hot strip from said stand for delivery therebeyond and wherein said strip is deflected while within said guide means;

said guide means comprising:

a guide plate adapted to guide said strip relative to said stand;

a supporting structure for mounting said guide plate adjacent said stand, and vertically spaced from said given path of travel, an elongated discharge nozzle having a continuous narrow uninterrupted discharge opening formed in said guide plate operatively carried by said supporting structure, and constructed and arranged to extend substantially across the full width of said strip, said supporting structure including means which in cooperation with said nozzle delivers a substantially uniform cross sectional coherent and non-turbulent curtain of coolant extending continuously between said nozzle and said strip in a manner that said curtain is maintained throughout said substantial distance irrespective of the degree of deflection of said strip and the distance between said strip and said nozzle, and means for supplying said coolant to said supporting structure.

2. In combination with a hot metal strip rolling mill stand according to claim 1, wherein a said guide means is provided above and below said path of travel of said strip for cooling the opposite sides of said strip.

3. In combination with a hot strip rolling mill stand as claimed in claim 2 wherein said discharge nozzle is recessed in said guide plate and does not project therefrom.

4. In combination with a rolling mill stand as claimed in claim 2 wherein said means for delivering comprises:

a coolant manifold incorporated in said supporting structure:

said manifold communicating with said nozzle and bound in part by said guide plate.

5. In combination with a hot strip rolling mill stand as claimed in claim 2, in which said nozzles are so angled that the coolant curtain from said nozzle below said pass-line impinges on said strip upstream of the impingement of the coolant curtain from said nozzle above said pass-line.

6. In a tandem mill for rolling in elongate form heated metal strip comprising:

a plurality of rolling mill stands;

a looper roll between at least one of said stands and the next stand downstream, said looper roll being displaceable whereby the inclination of said strips leaving said one stand is varied; and a pair of co-operating delivery guides for guiding said strip in relation to said one stand, and each including a guide plate and cooling equipment for said metal strip delivered by said one stand, said equipment including:

a supporting structure for supporting one said guide adjacent said stand, said structure being hollow and forming a manifold for coolant;

an elongate continuous narrow discharge nozzle carried by said supporting structure and in communication with said manifold, said nozzle being constructed and arranged to extend substantially the full width of said strip and to consistently deliver an uninterrupted non-turbulent curtain of coolant from said manifold through said guide plate on to said strip's surface irrespective of said inclination of said strip and said nozzle; and connections for supplying coolant to said manifold.

7. Cooling equipment as claimed in claim 6, wherein said nozzle is recessed behind the face of said guide plate and does not project beyond said face in the direction towards said strip.

8. Cooling equipment as claimed in claim 6, wherein said manifold contains at least one baffle plate which ensures constant flow of coolant to said nozzle.

9. A tandem mill for rolling metal in elongate form comprising:

a plurality of rolling mill stands, and for at least one of said stands, a pair of cooperating guides located above and below the pass-line of the mill for guiding said metal strip in relation to said stand;

each of said guides comprising:

a guide plate;

a supporting structure for said guide plates;

a manifold defined by said supporting structure and said guide plate;

an elongate continuous narrow discharge nozzle mounted in said guide plate and communicating with said manifold; and connection for supplying coolant to said manifold;

said nozzle delivering a coherent and non-turbulent curtain of coolant in a direction away from said guide plate and towards said pass-line onto said strip;

said nozzle in each said guide so angled that the coolant curtain from said nozzle below said pass-line impinges on said metal up-stream of the impingement of the coolant curtain from said nozzle above said pass-line.

* * * * *